US007862405B2

(12) United States Patent
Hashish

(10) Patent No.: US 7,862,405 B2
(45) Date of Patent: Jan. 4, 2011

(54) ZERO-TORQUE ORIFICE MOUNT ASSEMBLY

(75) Inventor: Mohamed A. Hashish, Bellevue, WA (US)

(73) Assignee: Flow International Corporation, Kent, WA (US)

( * ) Notice: Subject to any disclaimer, the term of this patent is extended or adjusted under 35 U.S.C. 154(b) by 1406 days.

(21) Appl. No.: 11/289,662

(22) Filed: Nov. 28, 2005

(65) Prior Publication Data

US 2007/0119992 A1 May 31, 2007

(51) Int. Cl.
*B24C 5/04* (2006.01)

(52) U.S. Cl. ..... 451/102

(58) Field of Classification Search ..... 451/102
See application file for complete search history.

(56) References Cited

U.S. PATENT DOCUMENTS 4,478,368 A * 10/1984 Yie ..... 451/102
4,936,512 A 6/1990 Tremoulet, Jr. ..... 239/596
5,092,085 A 3/1992 Hashish et al. ..... 51/439
5,144,766 A * 9/1992 Hashish et al. ..... 451/102
5,320,289 A * 6/1994 Hashish et al. ..... 451/102
5,851,139 A 12/1998 Xu ..... 451/102
6,280,302 B1 * 8/2001 Hashish et al. ..... 451/102
6,464,567 B2 * 10/2002 Hashish et al. ..... 451/102
6,752,686 B1 * 6/2004 Hashish et al. ..... 451/102
6,755,725 B2 * 6/2004 Hashish et al. ..... 451/102
6,875,084 B2 * 4/2005 Hashish et al. ..... 451/102
6,932,285 B1 * 8/2005 Zeng ..... 451/102
6,945,859 B2 * 9/2005 Hashish et al. ..... 451/102
2004/0107810 A1 * 6/2004 Sciulli et al. ..... 451/102

FOREIGN PATENT DOCUMENTS

WO 00/56466 9/2000

* cited by examiner

*Primary Examiner*—Maurina Rachuba
(74) *Attorney, Agent, or Firm*—Seed Intellectual Property Law Group PLLC

(57) ABSTRACT

A fluid jet system includes an upstream high-pressure body having a high-pressure bore axially positioned, a retaining nut configured to couple to the upstream high-pressure body, and an orifice mount assembly. The retaining nut includes a mounting chamber configured to laterally receive the orifice mount assembly without application of a torque while the retaining nut is coupled to the upstream high-pressure body and the system is at ambient pressure. A face seal may be mounted in either a downstream portion of the high-pressure bore or the orifice mount assembly to provide a high-pressure seal while the system is pressurized.

19 Claims, 7 Drawing Sheets

206

ZERO-TORQUE ORIFICE MOUNT ASSEMBLY

BACKGROUND OF THE INVENTION

1. Field of the Invention

The present invention relates to high-pressure fluid jet systems, and more particularly to orifice mount assemblies for such systems.

2. Description of the Related Art

FIG. 1 is a cross-section of a fluid jet cartridge assembly 100, according to known art. The fluid jet cartridge assembly 100 has a cartridge housing 105, a nozzle unit 110 and a discharge tube 115. The nozzle unit 110 is mounted to an upstream portion 120 of the cartridge housing 105. Typically, the cartridge housing 105 includes passageways 125, 130, 135 to allow high-pressure fluid flow therethrough and integrate abrasive particles into a fluid jet. Furthermore, the cartridge housing 105 has a bore 145 into which the discharge tube 115 is inserted and fixedly secured. The discharge tube 115 has a discharge passageway 150 defined by an interior surface 155 of the discharge tube 115.

In operation, the nozzle unit 110 receives a high-pressure fluid from a high-pressure fluid source (not shown). The nozzle unit 110 generates a high-pressure fluid jet, and discharges the fluid jet into the passageway 125. If a user wishes to create a high-pressure fluid jet with abrasive qualities, the user introduces abrasive particles into the chamber 135. The high-pressure fluid jet (with or without abrasive particles) then flows through the discharge passageway 150, being discharged at a nozzle end 160. The high-pressure fluid jet may be used for a variety of tasks, for example to cut materials or treat a surface.

Prolonged use of the fluid jet cartridge assembly 100 in a high-pressure fluid jet system leads to wear on assembly components, causing degradation of the high-pressure fluid jet and rendering performance of the fluid jet system less effective. Components that are particularly susceptible to wear are the nozzle unit 110, the interior surface 155 of the discharge tube 115 that defines the discharge passageway 150, and seals/rings (not shown) that maintain the high-pressure integrity of the fluid flow. However, it is unlikely that the components of the fluid jet cartridge assembly 100 will wear at the same rate. For example, introduction of abrasive particles into the high-speed fluid stream may cause the seals and the interior surface 155 of the discharge tube 115 to wear at faster rates than other components. Or automated, sustained use of the fluid jet cartridge assembly 100 with or without introduction of abrasive particles into the high-speed fluid stream may cause the nozzle unit 110 to suffer faster wear. What is needed is a system and method of replacing individual components of a fluid jet system based upon the amount of wear of each component in a manner that is both cost effective and which requires minimum effort and system downtime.

BRIEF SUMMARY OF THE INVENTION

In one embodiment of the present invention, a fluid jet system includes an upstream high-pressure body having a high-pressure bore axially positioned, a retaining nut configured to couple to the upstream high-pressure body, and an orifice mount assembly. The retaining nut includes a mounting chamber configured to laterally receive the orifice mount assembly without application of a torque while the retaining nut is coupled to the upstream high-pressure body. The retaining nut also includes a downstream fluid jet passageway coaxially positioned with the high-pressure bore. The high-pressure bore includes an upstream portion axially positioned and a downstream portion coaxially positioned with the upstream portion.

In one embodiment, the orifice mount assembly includes an orifice mount having an upstream surface having a recess, and an orifice mounted in the recess. The orifice includes an orifice opening. The orifice opening is located proximate the downstream portion of the high-pressure bore when the orifice mount assembly is positioned in the mounting chamber. In another embodiment, the orifice mount assembly includes an adapter configured to hold the orifice mount. In one embodiment, the orifice and the orifice mount are made out of a single part of sufficient strength and wear resistance such as ceramic, or carbide. Example materials are partially stabilized zirconia (PSZ), Silicon Nitride, and Aluminum Oxide. Also, a coating may be used to obtain a hard orifice surface when the mount is made out of softer materials. An example coating is diamond.

In one embodiment, the downstream portion of the high-pressure bore includes a face seal having an inner surface forming a high-pressure passageway connecting the upstream portion of the high-pressure bore to the orifice opening, and a downstream surface adapted to provide a high-pressure seal with the orifice while the orifice mount assembly is positioned in the mounting chamber and the system is pressurized.

In yet another embodiment, the orifice mount assembly includes an orifice mount having an upstream surface having a first recess. The first recess has a downstream surface, and the downstream surface has a second recess. A face seal is mounted in the first recess. The face seal has an inner surface forming a high-pressure pathway. The system is adapted such that an upstream portion of the high-pressure pathway is located proximate the downstream portion of the high-pressure bore when the orifice mount assembly is positioned in the mounting chamber. Furthermore, the orifice mount has an orifice mounted in the second recess. The orifice includes an orifice opening located proximate a downstream portion of the high-pressure pathway.

Additionally, the orifice mount has a fluid jet passageway configured to extend between the orifice opening and the downstream fluid jet passageway when the orifice mount assembly is positioned in the mounting chamber. The face seal has an upstream surface adapted to provide a high-pressure seal with the mounting chamber while the system is pressurized.

In another embodiment of the present invention, a fluid jet system includes an orifice mount assembly and a high-pressure body. The high-pressure body includes a high-pressure bore having an upstream portion axially positioned and a downstream portion coaxially positioned with the upstream portion, a downstream fluid jet passageway coaxially positioned with the high-pressure bore, and a mounting chamber positioned between the downstream portion of the high-pressure bore and the downstream fluid jet passageway. The mounting chamber is adapted to laterally receive the orifice mount assembly without application of a torque.

In yet another embodiment of the present invention, a fluid jet system includes a retaining nut configured to couple to an upstream high-pressure body, the retaining nut having a mounting chamber configured to laterally receive an orifice mount assembly without application of a torque while the retaining nut is coupled to the upstream high-pressure body.

In another embodiment of the present invention, a fluid jet system includes an orifice mount assembly configured to be laterally received into a mounting chamber of a retaining nut without application of torque to the orifice mount assembly while the retaining nut is coupled to an upstream high-pressure body.

A method of using an orifice mount assembly in a fluid jet system includes inserting the orifice mount assembly laterally into an orifice mounting chamber of the fluid jet system without application of torque to the orifice mount assembly or the fluid jet system, and pressurizing the fluid, thereby enabling the orifice mount assembly to self-seal with the fluid jet system. The method further includes depressurizing the fluid, and removing the orifice mount assembly from the orifice mounting chamber without application of torque to the orifice mount assembly or the fluid jet system.

DETAILED DESCRIPTION OF THE INVENTION

Figure 1:
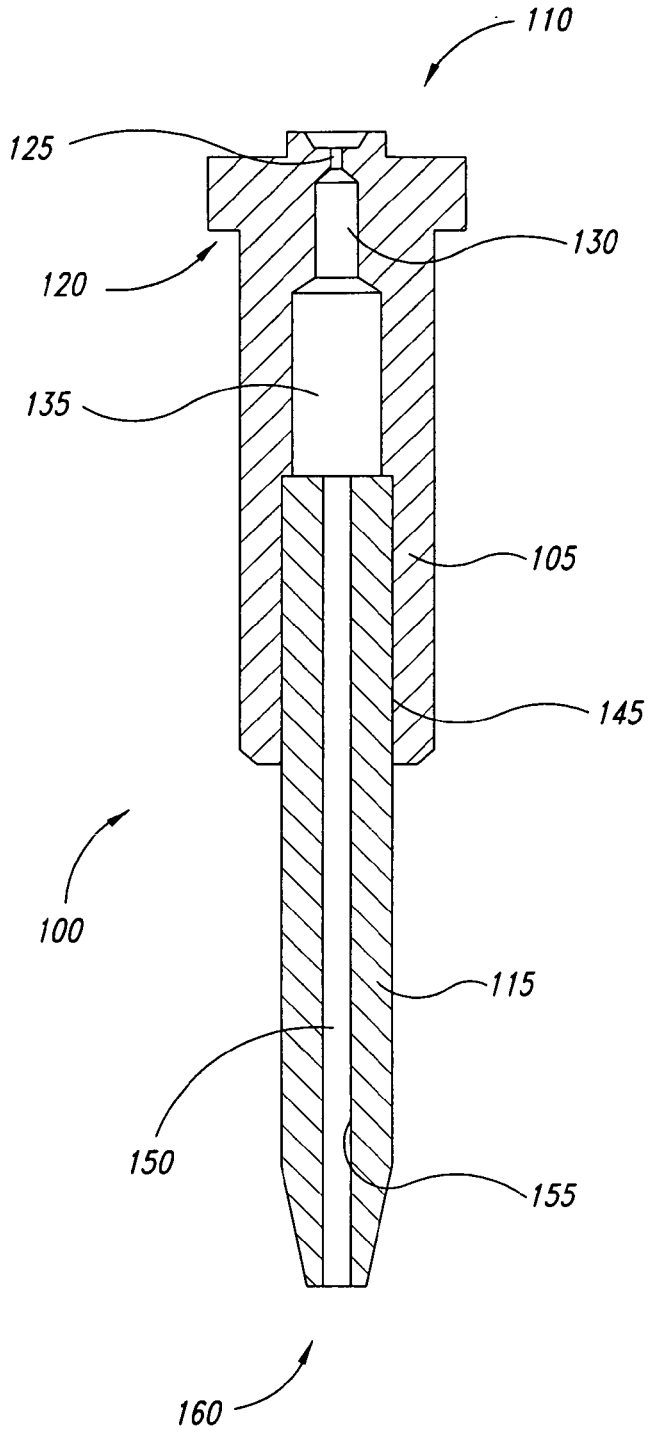
FIG. 1 (Prior Art)
FIG. 1 is a cross-section of a fluid jet cartridge assembly, according to known art.
Figure 2:
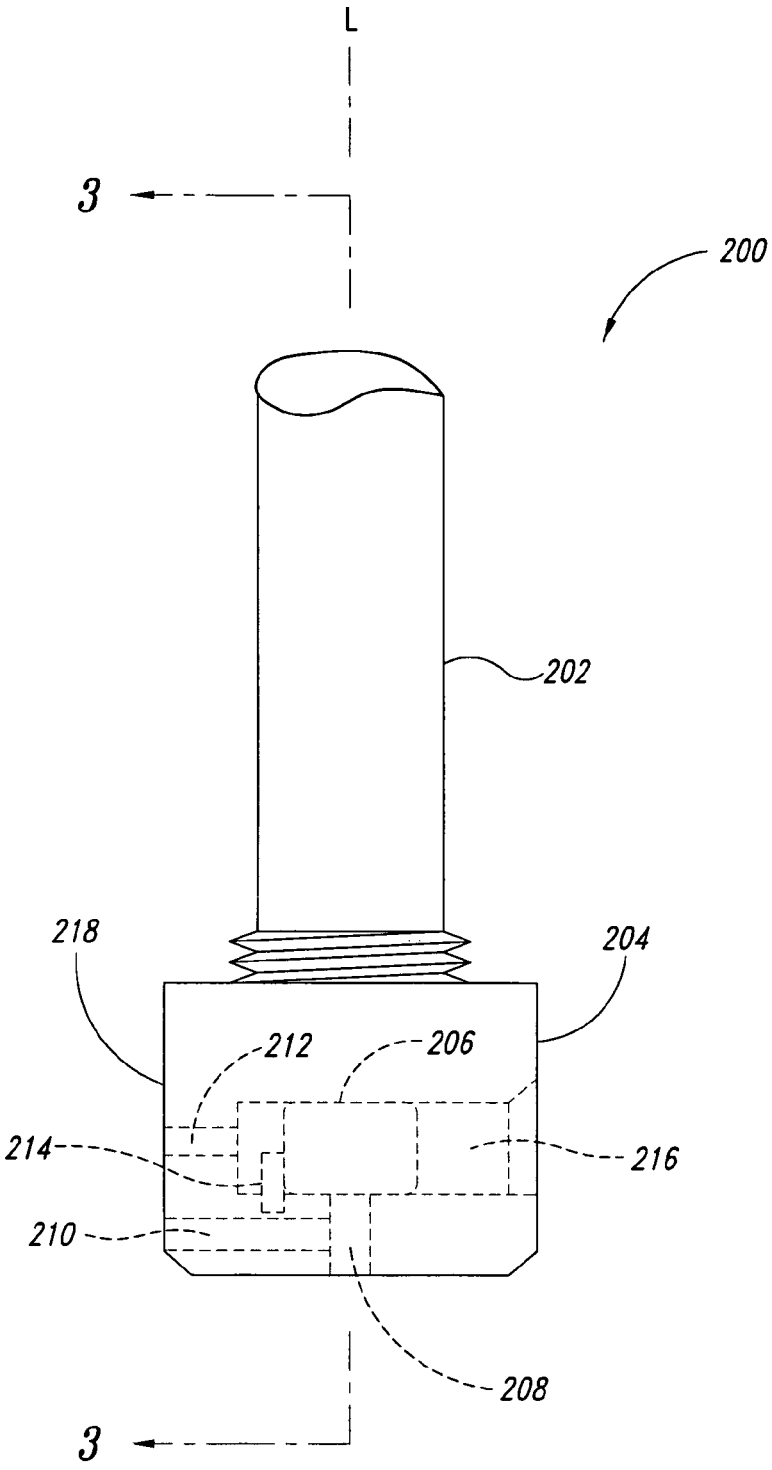
FIG. 2 is a front elevational view of a high-pressure fluid jet system, according to an embodiment of the present invention.

FIG. 2 is a front elevational view of a high-pressure fluid jet system 200, according to an embodiment of the present invention. The high-pressure fluid jet system 200 includes an upstream high-pressure body 202, a retaining nut 204, and a zero-torque orifice mount assembly 206 (also referred to as the orifice mount assembly 206). The retaining nut 204 has a downstream fluid jet passageway 208, an optional sensor port 210, a dismount port 212, one or more locating pins 214 and a mounting chamber 216. As discussed further below in conjunction with FIGS. 3-5, the orifice mount assembly 206 may be inserted or removed from the mounting chamber 216 without applying any torque to the orifice mount assembly 206, the retaining nut 204, or the upstream high-pressure body 202.

In order to prepare the system 200 for operation, a user laterally inserts the orifice mount assembly 206 into the mounting chamber 216, guided by the locating pins 214. The locating pins 214 provide for proper alignment and/or help seat the orifice mount assembly 206 in the mounting chamber 216, such that the upstream high-pressure body 202, the orifice mount assembly 206 and the downstream fluid jet passageway 208 are aligned along a common longitudinal axis L. A fluid under high pressure is then introduced into the upstream high-pressure body 202. For example, a high-pressure fluid source (not shown) may be connected through one or more valves (not shown) to the upstream high-pressure body 202. The orifice mount assembly 206 receives the high-pressure fluid, generates a high-speed fluid jet, and discharges the fluid jet via the downstream fluid jet passageway 208. As will be discussed further below in conjunction with FIGS. 3-5, the system 200 utilizes the high-pressure fluid not only to generate the high-speed fluid jet, but to also enable high-pressure self-sealing mechanisms that maintain the fluid under high-pressure and prevent leaks. While operational, the user may use the high-speed fluid jet to clean objects or cut material, for example.

The sensor port 210 extends from a surface 218 of the retaining nut 204 to the downstream fluid jet passageway 208, and the dismount port 212 extends from the surface 218 to the mounting chamber 216. While system 200 is operational, a sensor such as a vacuum gage (not shown) or an air flow meter (not shown) can be connected to the sensor port 210 to determine the condition or characteristics of the high-speed fluid jet in the downstream fluid jet passageway 208, thereby indirectly determining the condition of the orifice mount assembly 206. If the user wishes to remove the orifice mount assembly 206 from the mounting chamber 216, the user disconnects the system 200 from the high-pressure fluid source, or otherwise allows the system 200 to return to ambient pressure. The user may then insert an object, such as a pin, for example, into the dismount port 212 to displace the orifice mount assembly 206 from the mounting chamber 216. Also, the orifice mount assembly load and unload can be automated using an appropriate mechanism.

Figure 3:
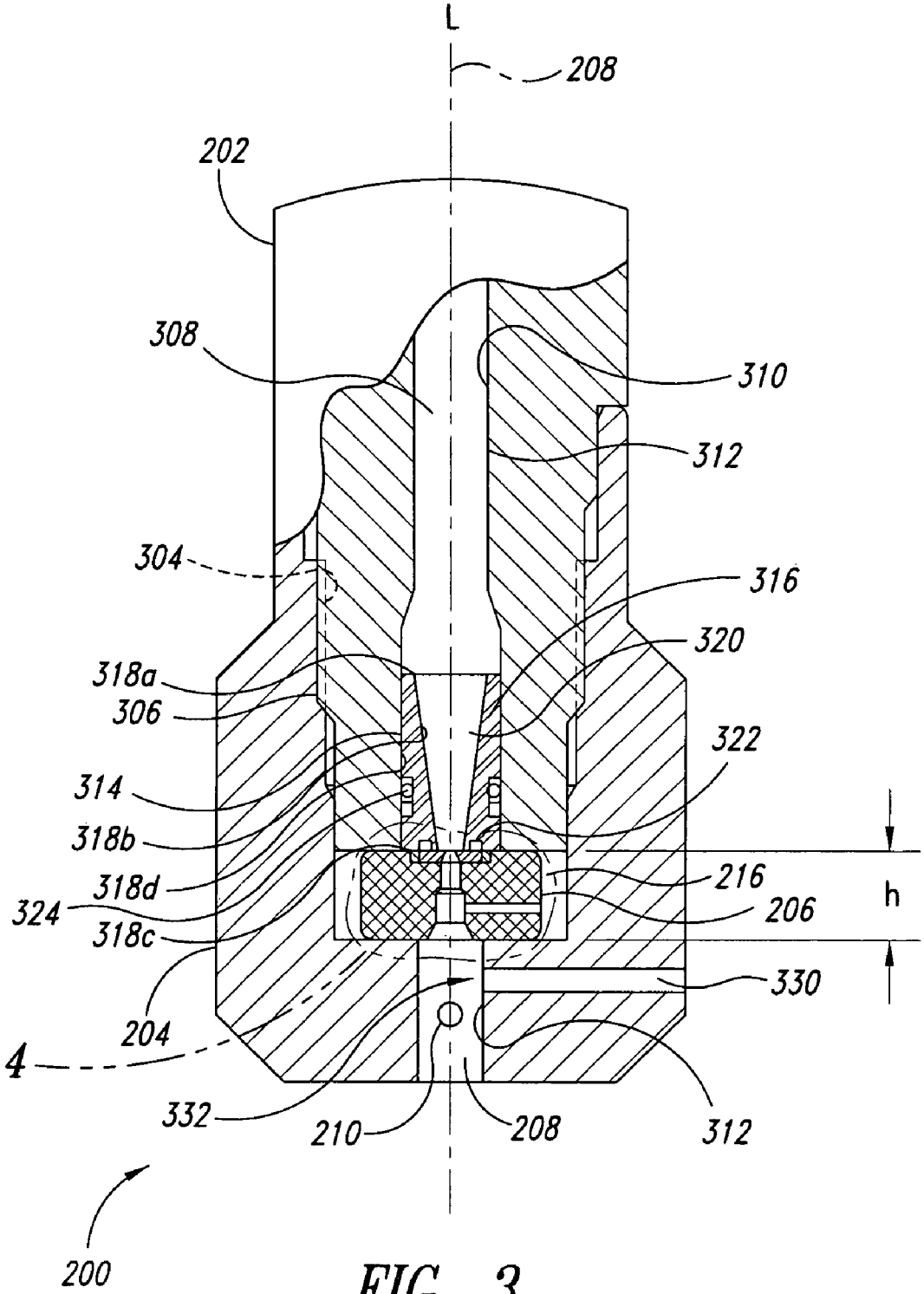
FIG. 3 is a partial cross-section of the high-pressure fluid jet system of FIG. 2, according to an embodiment of the present invention.

FIG. 3 is a partial cross-section of the high-pressure fluid jet system 200 of FIG. 2 taken along section 3-3, according to an embodiment of the present invention. In the embodiment as illustrated, the upstream high-pressure body 202 includes a threaded outer surface 304. The retaining nut 204 includes a threaded inner surface 306 configured such that the retaining nut 204 may be coupled to the upstream high-pressure body 202 by engaging the threaded inner surface 306 of the retaining nut 204 with the threaded outer surface 304 of the upstream high-pressure body 202. A mounting chamber height h may be changed and/or selected by rotating the retaining nut 204 about the longitudinal axis L. In selecting a proper chamber height h to receive the orifice mount assembly 206 and enable the sealing mechanisms (discussed below) to properly function once the system 200 is pressurized, a user may insert a "dummy" orifice mount (not shown) into the mounting chamber 216, and rotate the retaining nut 204 to decrease the chamber height h until the "dummy" orifice mount is secured in the mounting chamber 216. An adhesive may then be applied to the threaded outer surface 304 to lock the retaining nut 204 in position on the upstream high-pressure body 202. The "dummy" orifice mount is then removed from the mounting chamber 216, and the orifice mount assembly 206 is positioned in the mounting chamber 216. Selection of the chamber height h allows the user to laterally insert the orifice mount assembly 206 into the mounting chamber 216 without application of any torque to the orifice mount assembly 206, and to properly enable the system 200 to self-seal while pressurized.

The upstream high-pressure body 202 includes a high-pressure bore 308 defined by an inner surface 310. The high-pressure bore 308 includes an upstream portion 312 axially positioned (i.e., centered about the longitudinal axis L) and a downstream portion 314 coaxially positioned with the upstream portion 312. The high-pressure bore 308 may be configured as illustrated in FIG. 3, or it may be configured to have any diameter and/or variation along the longitudinal axis L, or any size or shape. The retaining nut 204 may optionally include an injection passageway 330 for connecting a portion 332 of the downstream fluid jet passageway 208 with a source of abrasive particulate matter in order to generate an abrasive high-speed fluid jet. As such, passageway 208 may function as a mixing chamber, and may also selectively receive a mixing tube, not shown, of a hard material.

As illustrated, a face seal 316 is mounted in the downstream portion 314 of the high-pressure bore 308. The face seal 316 includes an upstream surface 318*a*, an inner surface 318*b*, a downstream surface 318*c* and an outer surface 318*d*. The inner surface 318*b* of the face seal 316 forms a high-pressure passageway 320 that connects the upper portion 312 of the high-pressure bore 308 to the mounting chamber 216. The high-pressure passageway 320 is coaxially positioned with the upstream portion 312 of the high-pressure bore 308. The lower surface 318*c* and the outer surface 318*d* of the face seal 316 are adapted to receive sealant units 322 and 324, respectively. In one embodiment of the present invention, the sealant units 322 and 324 are O-rings, however as one of skill in the art appreciates, the present invention covers other types of sealant units of various sizes, shapes, or material, including metal or rubber, for example. In an alternate embodiment, the sealant units 322, 324 and the face seal 316 are of a unitary design. The face seal 316 and the sealant units 322, 324 maintain high-pressure fluid flow within the high-pressure bore 308 and the orifice mount assembly 206. The face seal 316 is further described in U.S. Pat. No. 5,144,766.

Figure 4:
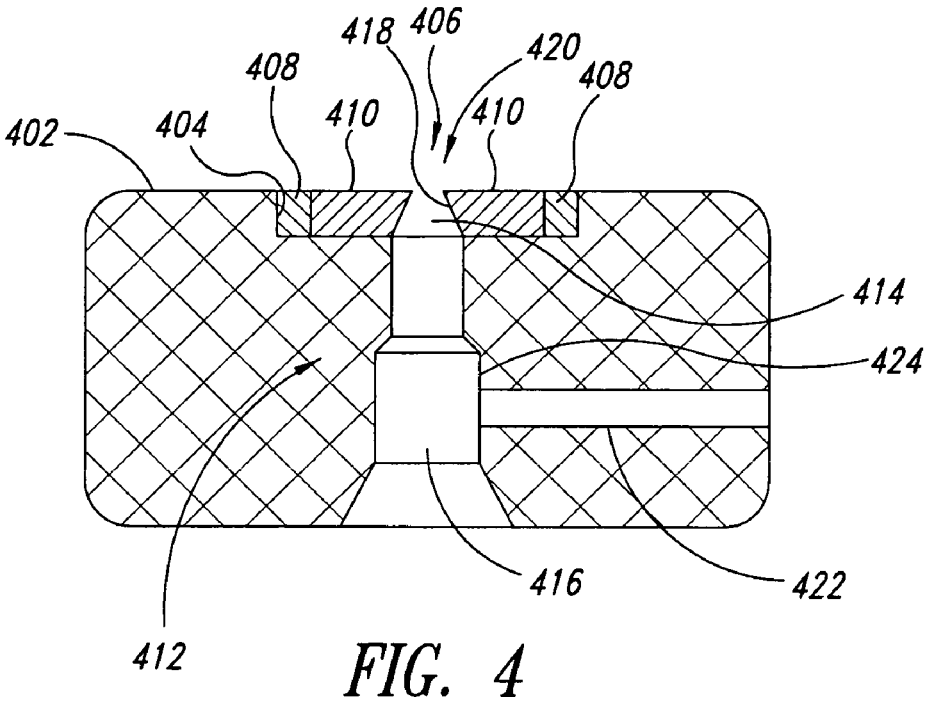
FIG. 4 is an enlarged cross-section of the zero-torque orifice mount of FIG. 3, according to an embodiment of the invention.

FIG. 4 is an enlarged cross-section of the zero-torque orifice mount assembly 206 of FIG. 3, according to an embodiment of the invention. The orifice mount assembly 206 includes an upstream surface 402 having a recess 404 for mounting a nozzle unit 406. In the embodiment as illustrated, the recess 404 is cylindrically shaped, although the scope of the invention covers recesses of any shape. The nozzle unit 406 includes a mounting ring 408 and an orifice 410. However, in other embodiments the nozzle unit 406 includes only the orifice 410. The orifice 410 includes a fluid jet passageway 414 that aligns with passageway 416 provided in the mount assembly 206 to form fluid jet passageway 412. The passageway 414 is formed by an inner surface 418 of the orifice 410, including an orifice opening 420. When the orifice mount assembly 206 is positioned in the mounting chamber 216 (FIG. 3), the orifice opening 420 is located proximate and coaxial with the high-pressure passageway 320 of the high-pressure bore 308. Additionally, the fluid jet passageway 412 extends from the orifice opening 420 to the downstream fluid jet passageway 208 (FIG. 3), connecting the high-pressure passageway 320 to the downstream fluid jet passageway 208. Although in the embodiment as illustrated, passageway 414 of the fluid jet passageway 412 is conically shaped, in other embodiments the upstream portion 414 may be of various shapes and sizes that are within the spirit of the present invention. The nozzle unit 406, including the orifice 410 and the mounting ring 408, are disclosed in further detail in U.S. Pat. No. 5,144,766. In one embodiment, the mounting ring 408 is an O-ring and the orifice 410 is a jewel orifice. The orifice mount assembly 206 may optionally include a passageway to connect to a sensor (not shown) or to simply allow a small amount of air to enter into the passageway 416 to prevent an excessive vacuum from forming.

Referring back to FIG. 3, when the system 200 is pressurized, fluid in the high-pressure bore 308 exerts a first downstream-directed force on the upstream surface 318*a* of the face seal 316 and a second downstream-directed force on the inner surface 318*b* of the face seal 316, causing the downstream surface 318*c* to form a high-pressure seal with the orifice mount assembly 206 (FIG. 4). More specifically, the first and second downstream-directed forces are transmitted through the face seal 316 to the sealant unit 322, deforming the sealant unit 322 to provide the high-pressure seal with the orifice mount assembly 206. In effect, the face seal 316 provides a high-pressure seal with the orifice mount assembly 206 while the system 200 is pressurized. In contrast, when the system 200 is at ambient pressure, the high-pressure seal between the face seal 316 and the orifice mount assembly 206 is broken, and the orifice mount assembly 206 may then be removed from the mounting chamber 216 without application of a torque to the orifice mount assembly 206.

Furthermore, the high-pressure fluid contained within the high-pressure passageway 320 exerts a lateral force directed radially outward (i.e., directed away from the longitudinal axis L) that deforms the sealant unit 324, thereby preventing pressurized fluid to leak along the outer surface 318*d* from the upstream portion 312 of the high-pressure bore 308 to the mounting chamber 216. The forces generated by the high-pressure fluid on the face seal 316 allow the system 200 to be self-sealing. In other words, the face seal 316 and the sealant units 322, 324 in conjunction with the orifice mount assembly 206 and the downstream portion 314 of the high-pressure bore 308, are enabled by the high-pressure fluid to be self-sealing, thereby maintaining and containing the high-pressure fluid within the passageways and bores of the high-pressure fluid jet system 200.

Figure 5:
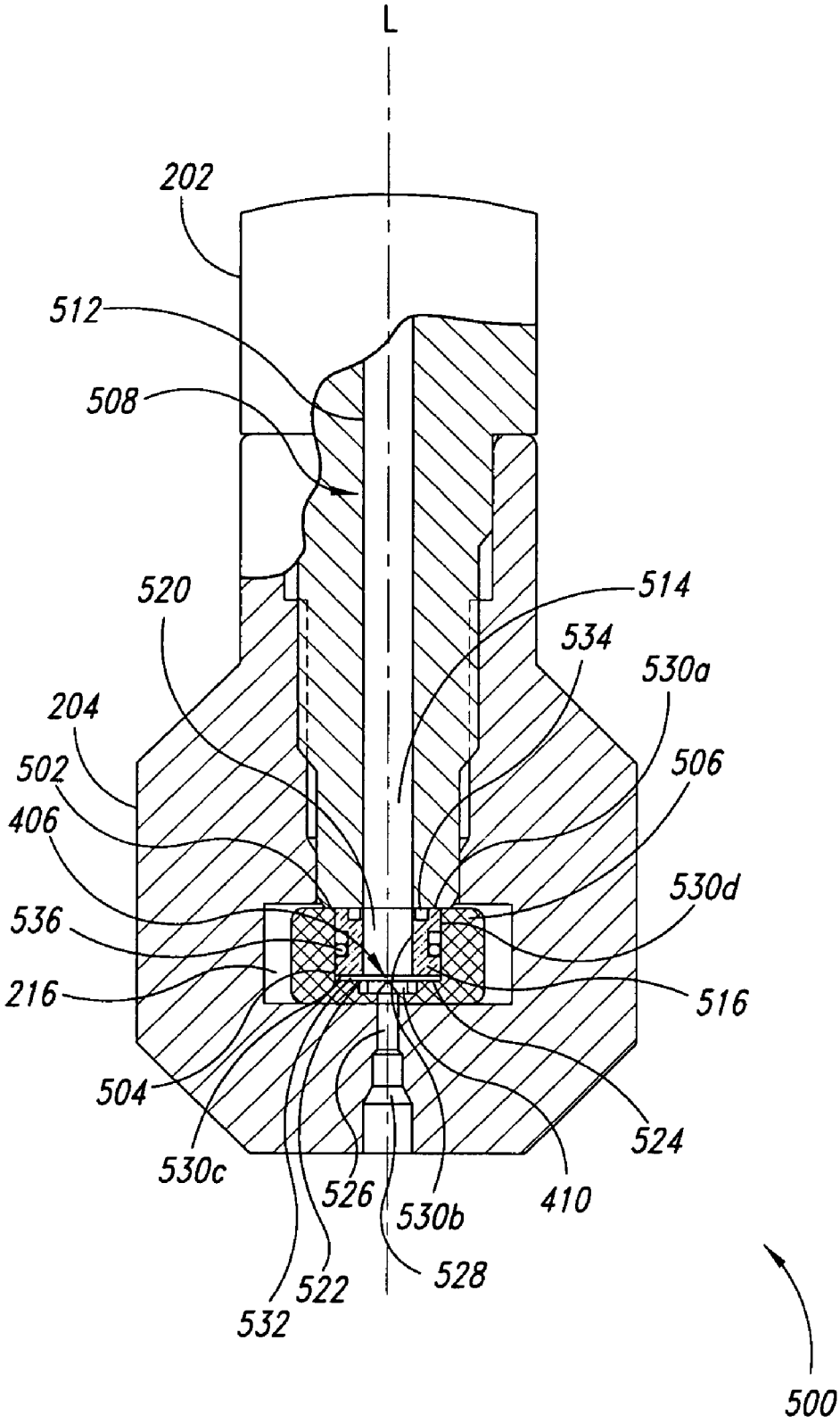
FIG. 5 is a partial cross-section of the high-pressure fluid jet system of FIG. 2, according to another embodiment of the present invention.

FIG. 5 is a partial cross-section of a high-pressure fluid jet system 500, according to an embodiment of the present invention. Fluid jet system 500 is substantially identical to fluid jet system 200, except that fluid jet system 500 includes an orifice mount assembly 506 having a face seal 516 and a high-pressure passageway 520. Furthermore, as illustrated, a downstream portion 514 of a high-pressure bore 508 is substantially identical to an upstream portion 512 of the high-pressure bore 508. Additionally, the orifice mount assembly 506 includes an upstream surface 502 having a first recess 504 for mounting the face seal 516. The orifice mount assembly 506 includes a second recess 522 formed in a downstream surface 524 of the first recess 504. The nozzle unit 406 is mounted in the second recess 522. A fluid jet passageway 526 connects the nozzle unit 406 to a downstream fluid jet passageway 528.

The face seal 516 includes an upstream surface 530*a*, an inner surface 530*b*, a downstream surface 530*c* and an outer surface 530*d*. The inner surface 530*b* of the face seal 516 forms the high-pressure passageway 520 that connects the lower portion 514 of the high-pressure bore 508 to the orifice opening 420 (FIG. 4) of the orifice 410. The high-pressure passageway 520 is coaxially positioned with the high-pressure bore 508 and the orifice opening 420 of the orifice 410. As illustrated, the face seal 516 is mounted in the first recess 504 such that a gap 532 is formed between the downstream surface 530*c* of the face seal 516 and the downstream surface 524 of the first recess 504. The upstream surface 530*a* and outer surface 530*d* of the face seal 516 are adapted to receive sealant units 534 and 536, respectively. In one embodiment of the present invention, the sealant units 534 and 536 are O-rings, however as one of skill in the art appreciates, the present invention covers other types of sealant units of various sizes, shapes, or material, including metal or rubber, for example. In an alternate embodiment, the sealant units 534-536 and the face seal 516 are of a unitary design.

When the high-pressure bore 508 contains fluid under pressure (i.e., the system 500 is pressurized), the high-pressure fluid contained within the high-pressure passageway 520 exerts a radial force (i.e., directed radially away from the longitudinal axis L) on the inner surface 530*b* of the face seal 516 and the high-pressure fluid contained within the gap 532 exerts an upstream-directed force (also referred to as an upstream force) on the downstream surface 530*c* of the face seal 516. The upstream force causes the sealant unit 534 to deform, thereby sealing the orifice mount assembly 506 with the upstream high-pressure body 202. The radial force causes the sealant unit 536 to deform, thereby preventing high-pressure fluid contained within the gap 532 from leaking into the mounting chamber 216. Sealants 534 and 536 are enabled by the high-pressure fluid contained within the system 500 to maintain the pressure of the fluid and prevent high-pressure fluid from leaking into the mounting chamber 216. When the system 500 is at ambient pressure, the sealant unit 534 does not seal the orifice mount assembly 506 to the upstream high-pressure body 202, thus the orifice mount assembly 506 may be removed from the mounting chamber 216 without application of a torque.

The system 500 is designed such that when the orifice mount assembly 506 is positioned in the mounting cavity 216, the high-pressure bore 508, the high-pressure passageway 520, the orifice opening 420, the fluid jet passageway 526 and the downstream fluid jet passageway 528 are coaxial with each other along the longitudinal axis L.

Figure 6:
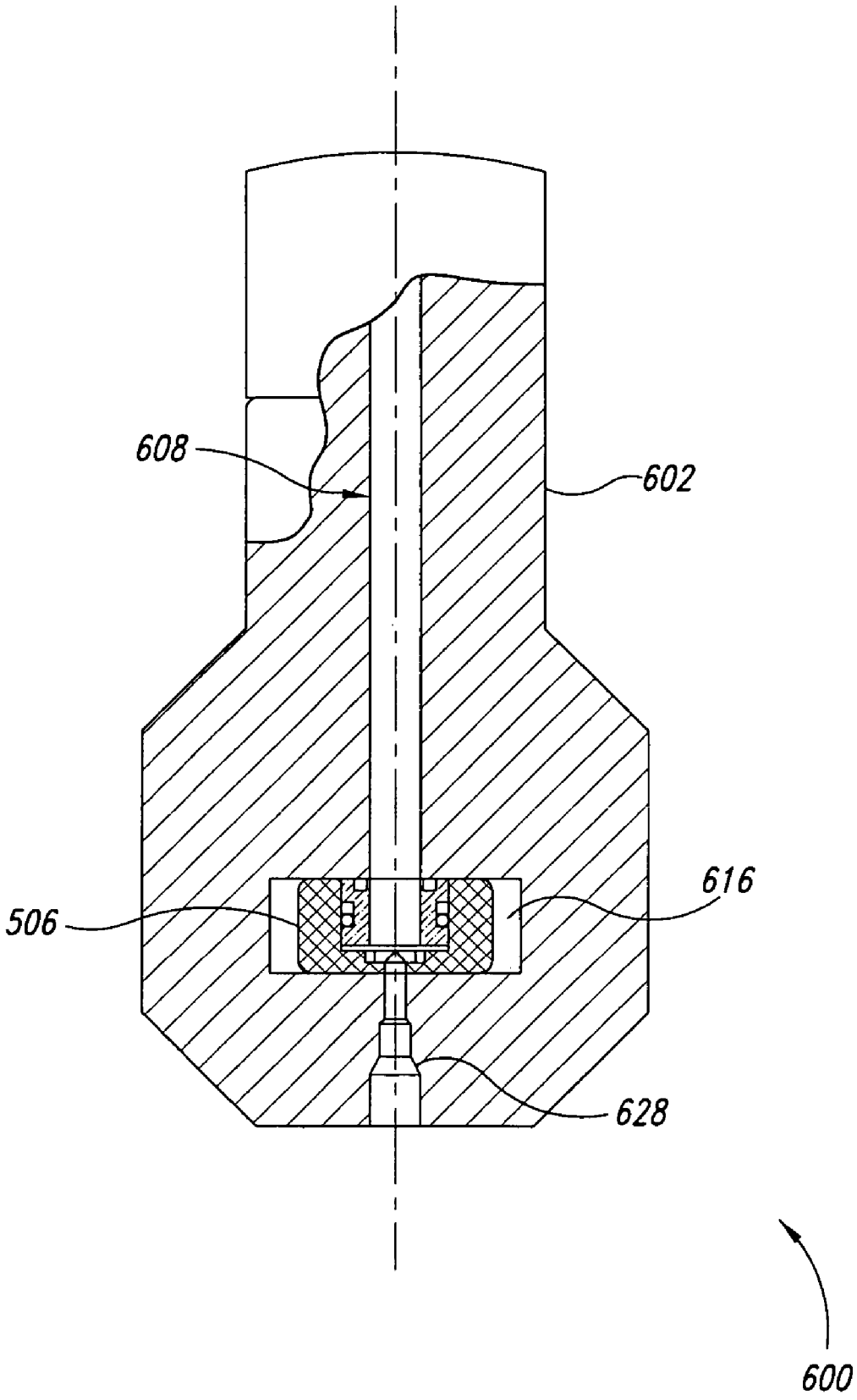
FIG. 6 is a partial cross-section of a high-pressure fluid jet system, according to yet another embodiment of the present invention.

FIG. 6 is a partial cross-section of a high-pressure fluid jet system 600, according to an embodiment of the present invention. Fluid jet system 600 is substantially identical to fluid jet system 500, except that fluid jet system 600 includes a unitary high-pressure body 602 that replaces the upstream high-pressure body 202 and the retaining nut 204 of system 500. In the embodiment as illustrated, the high-pressure body 602 includes a high-pressure bore 608, a mounting chamber 616, and a downstream fluid jet pathway 628. The mounting chamber 616 is adapted to mount the orifice mount assembly 506.

Figure 7A:
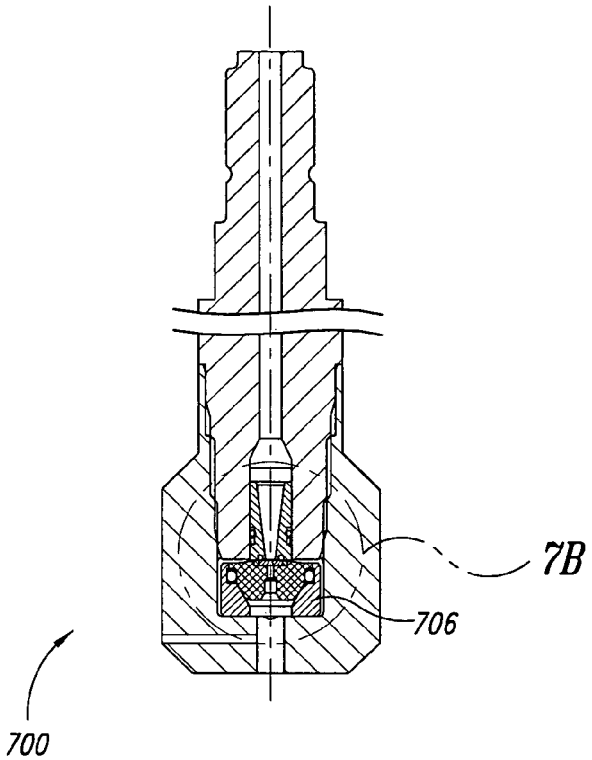
FIG. 7A is a cross-section of a high-pressure fluid jet system, according to yet another embodiment of the present invention.

FIG. 7A is a cross-section of a high-pressure fluid jet system 700, according to an embodiment of the present invention. The high-pressure fluid jet system 700 includes an orifice mount assembly 706. Except for the orifice mount assembly 706, the fluid jet system 700 is substantially identical to the fluid jet system 200.

Figure 7B:
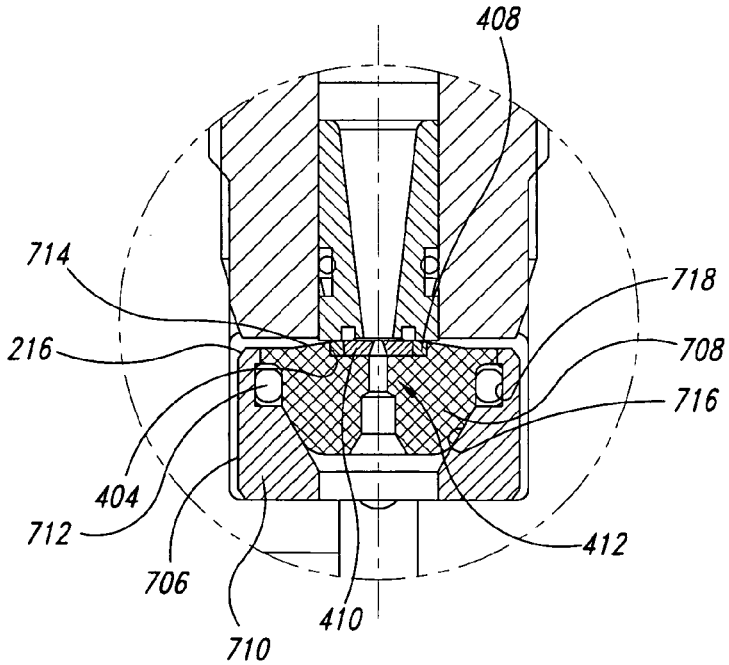
FIG. 7B is an enlarged view of a portion of the fluid jet system of FIG. 7A.

FIG. 7B is an enlarged view of a portion of the fluid jet system 700 of FIG. 7A. The orifice mount assembly 706 includes an orifice mount 708, an adapter 710 and an assembly ring 712. The orifice mount 708 includes an orifice 410, a mounting ring 408, and a fluid jet passageway 412. The orifice mount 708 also includes an upper surface 714 having a recess 404 for receiving the mounting ring 408 and the orifice 410. In the embodiment as illustrated, an inner surface 716 of the adapter 710 includes a recess 718 to receive and couple with the assembly ring 712. Furthermore, the inner surface 716 of the adapter 710 is shaped to form a cavity for holding the orifice mount 708 in conjunction with the assembly ring 712.

As may be appreciated by one of skill in the art, the present invention covers adapters of various shapes and for holding orifice mounts of various shapes and sizes. As an exemplary illustration of assembling the orifice mount assembly components, a user inserts the orifice mount 708 into the cavity formed by the inner surface 716 of the adapter 710, using the assembly ring 712 to properly position and couple the orifice mount 708 to the adapter 706. The orifice mount assembly 706 may then be inserted or removed from the mounting chamber 216.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A fluid jet system, comprising:
an orifice mount assembly; and
a high-pressure body configured to couple to a mixing tube, the high-pressure body including
a high-pressure bore having an upstream portion axially positioned and a downstream portion coaxially positioned with the upstream portion;
a downstream fluid jet passageway coaxially positioned with the high-pressure bore; and
a mounting chamber positioned between the downstream portion of the high-pressure bore and the downstream fluid jet passageway, the mounting chamber configured to laterally receive the orifice mount assembly without application of a torque while the mixing tube is coupled to and stationary with respect to the high-pressure body.

2. The fluid jet system of claim 1 wherein the downstream fluid jet passageway comprises a mixing chamber.

3. The fluid jet system of claim 1 wherein the mounting chamber comprises at least one locating pin to coaxially align the orifice mount assembly with the high-pressure bore when the orifice mount assembly is positioned in the mounting chamber.

4. The fluid jet system of claim 1 wherein the high-pressure body further comprises a sensor port extending from an outside surface of the high-pressure body to the downstream fluid jet passageway.

5. The fluid jet system of claim 1 wherein the high-pressure body further comprises a dismount port extending from an outside surface of the high-pressure body to the mounting chamber, the dismount port configured to receive a pin to dismount the orifice mount assembly from the mounting chamber.

6. The fluid jet system of claim 1 wherein the orifice mount assembly comprises:
an orifice mount including
an upstream surface having a recess; and
an orifice mounted in the recess, the orifice including an orifice opening, the orifice opening located proximate the downstream portion of the high-pressure bore when the orifice mount assembly is positioned in the mounting chamber.

7. The fluid jet system of claim 6 wherein the orifice mount assembly further comprises an adapter configured to hold the orifice mount.

8. The fluid jet system of claim 6 wherein the orifice mount further comprises a fluid jet passageway configured to extend between the orifice opening and the downstream fluid jet passageway when the orifice mount assembly is positioned in the mounting chamber.

9. The fluid jet system of claim 6 wherein the downstream portion of the high-pressure bore further comprises a face seal, the face seal having
an inner surface forming a high-pressure passageway connecting the upstream portion of the high-pressure bore to the orifice opening; and
a downstream surface adapted to provide a high-pressure seal with the orifice while the orifice mount assembly is positioned in the mounting chamber and the system is pressurized.

10. The fluid jet system of claim 9 wherein the downstream surface of the face seal is configured to receive a sealant unit to provide the high-pressure seal with the orifice while the orifice mount assembly is positioned in the mounting chamber and the system is pressurized.

11. The fluid jet system of claim 1 wherein the orifice mount assembly comprises:

an orifice mount including an upstream surface having a first recess, the first recess having a downstream surface, the downstream surface having a second recess;

a face seal mounted in the first recess, the face seal having an inner surface forming a high-pressure pathway, an upstream portion of the high-pressure pathway located proximate the downstream portion of the high-pressure bore when the orifice mount assembly is positioned in the mounting chamber;

an orifice mounted in the second recess, the orifice including an orifice opening, the orifice opening located proximate a downstream portion of the high-pressure pathway; and a fluid jet passageway configured to extend between the orifice opening and the downstream fluid jet passageway when the orifice mount assembly is positioned in the mounting chamber.

12. The fluid jet system of claim 11 wherein the face seal has an upstream surface adapted to provide a high-pressure seal with the mounting chamber while the system is pressurized.

13. The fluid jet system of claim 12 wherein the upstream surface of the face seal is configured to receive a sealant unit to provide the high-pressure seal with the mounting chamber while the system is pressurized.

14. The fluid jet system of claim 11 wherein the orifice mount assembly further comprises an adapter for holding the orifice mount.

15. A fluid jet system, comprising:

a retaining nut having an upstream portion configured to couple to an upstream high-pressure body and a downstream portion configured to couple to a mixing tube, the retaining nut including a mounting chamber configured to laterally receive an orifice mount assembly without application of a torque while the upstream portion of the retaining nut is coupled to the upstream high-pressure body and the downstream portion of the retaining nut is coupled to and stationary with respect to the mixing tube.

16. The fluid jet system of claim 15, further comprising the orifice mount assembly, the orifice mount assembly configured to be self-sealing with the upstream high-pressure body while the system is pressurized.

17. A fluid jet system, comprising:

an orifice mount assembly configured to be laterally received into a mounting chamber of a retaining nut without application of torque to the orifice mount assembly while the retaining nut is coupled to an upstream high-pressure body and the retaining nut holds a mixing tube stationary with respect to the upstream high-pressure body and while the system is at ambient pressure.

18. The fluid jet system of claim 17, further comprising the upstream high-pressure body, the orifice mount assembly configured to be self-sealing with the upstream high-pressure body while the system is pressurized.

19. The fluid jet system of claim 1 wherein the downstream fluid jet passageway is configured to receive the mixing tube.

* * * * *